United States Patent [19]

Rothstein

[11] 4,439,165

[45] Mar. 27, 1984

[54] AQUATIC BODY BOARD

[75] Inventor: Andrew M. Rothstein, Santa Monica, Calif.

[73] Assignees: Harold Louis Rothstein; Arthur Rothstein, both of Los Angeles, Calif.

[21] Appl. No.: 293,391

[22] Filed: Aug. 17, 1981

[51] Int. Cl.[3] ..... A63C 15/05

[52] U.S. Cl. ..... 441/74; D21/228

[58] Field of Search ..... 441/35, 40, 65, 66, 441/67, 74, 80, 81, 82, 129, 130, 132, 136, 135; 114/220; 272/1 B; 16/110 R, DIG. 2, DIG. 18, DIG. 19; D21/236–237, 228

[56] References Cited

U.S. PATENT DOCUMENTS

| | | | |
|---|---|---|---|
| D. 263,860 | 4/1982 | Cole | D21/236 |
| D. 264,370 | 5/1982 | McCarthy | D21/237 |
| 1,023,601 | 4/1912 | Simpson | 441/65 |
| 2,021,713 | 11/1935 | Borino | 272/1 B |
| 2,894,270 | 7/1959 | Manthos | 441/131 |
| 3,042,945 | 7/1962 | Saeman | 441/135 |
| 3,081,726 | 3/1963 | Betts et al. | 441/135 |
| 3,147,498 | 9/1964 | Convis | 441/65 |
| 3,763,817 | 10/1973 | Francis | 114/270 |

FOREIGN PATENT DOCUMENTS

| | | | |
|---|---|---|---|
| 135858 | 2/1901 | Fed. Rep. of Germany | 441/131 |
| 2545232 | 4/1977 | Fed. Rep. of Germany | 441/74 |
| 1163564 | 9/1958 | France | 441/135 |
| 393959 | 11/1965 | Switzerland | 441/66 |
| 1397456 | 6/1975 | United Kingdom | 441/135 |

*Primary Examiner*—Trygve M. Blix
*Assistant Examiner*—Thomas J. Brahan
*Attorney, Agent, or Firm*—Natan Epstein

[57] ABSTRACT

An improved body board having a planar upper surface, a forward end and a pair of lateral edges is provided with a novel bow-shaped substantially rigid arcuate control member having two ends and a convex intermediate portion and is secured in fixed spaced relationship to the upper side of the body board. The bow-shaped grip spans the greater part of the width of the board between the lateral edges and is so oriented that the convex intermediate portion extends forwardly while the ends extend rearwardly. In a preferred embodiment, the rear ends terminate flush with the upper surface of the board and the arcuate handle slants upwardly from the upper surface of the board such that the grip of each hand on the handle may be continuously shifted along a substantial length of the handle to thereby obtain optimal leverage for effective steering of the board under shifting load and surf conditions.

6 Claims, 8 Drawing Figures

AQUATIC BODY BOARD

BACKGROUND OF THE INVENTION

1. Field of the Invention

This invention relates to boards used for aquatic sports such as surfing, and more particularly relates to an improved body board of the type where the rider lies down with his torso supported in the water by the body board, such as are commonly used for riding the waves on the seashore.

2. Background

Surfboards and body boards have been known for a long time and are in extensive use along seashores and coasts throughout the world. Recently, the so-called body boards have become popular and are used in great numbers by young and old, novice and expert, for fun at the beach. Unlike surfing, where a rider stands upright on a relatively long and narrow surfboard, a body board, is a relatively short, blunt nosed, and relatively wide board on which the rider lies down with his torso on the board and holds onto the sides of the board for riding the surf onto a beach. Riding a body board requires considerably less skill than surfing and is therefore accessible to wider participation.

Unlike a surfboard, a body board is relatively sluggish in response to body movements intended to steer the board in the water. A standing surfer can lean in the direction he wants to steer and is also free to step forward or backwards on the board to obtain a desired response from his craft. A rider of a body board does not have this freedom of movement since he is lying down on the board and will generally grasp the sides or forward end of the board with both hands simply to stay on the board. Thus, the steering of the board must be achieved by shifting the rider's weight through rolling movements over the board usually in conjunction with shifting the rider's grip along the sides of the board.

Conventional body boards have been found to be difficult to maneuver and are generally not nearly as responsive as conventional surfing boards. As the sport has gained wider acceptance, attempts have been made to make body boards more responsive by providing a small handle at the forward end of the board for improved steering. Such handles as have been heretofore provided have offered very limited improvement in control characteristics over the board and a need exists for further improvements in this area.

The handles heretofore provided have been relatively small, handles not large enough to be grasped with both hands, and requiring an unnatural, contorted, hand-over-hand grip at a fixed location on the board. The handles of the prior art are too small to allow any appreciable movement of the hand over the board to effect positive steering control over the board. In addition, these handles are made by looping a short length of flexible rope or cable. Such flexible handles in the form of a cable loop lack the rigidity necessary to permit the rider to develop good leverage against the board for maximum control, and are better suited for towing and carrying the board than for effectively steering the same.

Some boards are equipped with a leash attached to the forward end of the board and provided with a wrist strap attached to the rider's arm to prevent loss of the board in case of a spill.

It is particularly important to maintain control over the board while kicking into a wave from a standing start. Normal practice is to kick with the feet and paddle with one hand to enter the wave, so that only one hand is left for controlling the board. This critical maneuver is awkward with existing handles which do not allow the rider to grasp the handle at an advantageous point.

SUMMARY OF THE INVENTION

The present invention is an improved body board which has been provided with a bow-shaped, substantially rigid handle member extending across the greater part of the width of the board and is spaced upwardly from the top surface of the body board to allow either or both of the rider's hands to grip the member at continuously selectable points along the handle member such that the grip may be shifted as needed to obtain optimal leverage, stability and control under shifting load and surf conditions.

The arcuate member has two ends and an intermediate convexly-curved portion which is oriented towards the forward end of the board. The rearwardly-extending ends are attached to the board and in a preferred embodiment the handle slants upwardly in a forward direction. Thus, the upper surface of the arcuate member rises upwardly from the upper surface of the board towards the convex forwardly-oriented intermediate portion. A preferred handle structure is of flattened cross section with a generally planar upper surface, and is thicker at its middle that at either end. One or more auxiliary spacers may be provided for supporting the intermediate section of the bow handle.

Preferably, the rearwardly extending end positions terminate substantially flush with the upper surface of the board. The rider is thus able to slide either or both hands from the handle down to the lateral edges of the board without releasing his hold on the board. Similarly, it is possible to enter the surf while holding the board by the side edges and then to smoothly slide the hands onto the handle without groping for it.

DETAILED DESCRIPTION OF THE INVENTION

Figure 1:
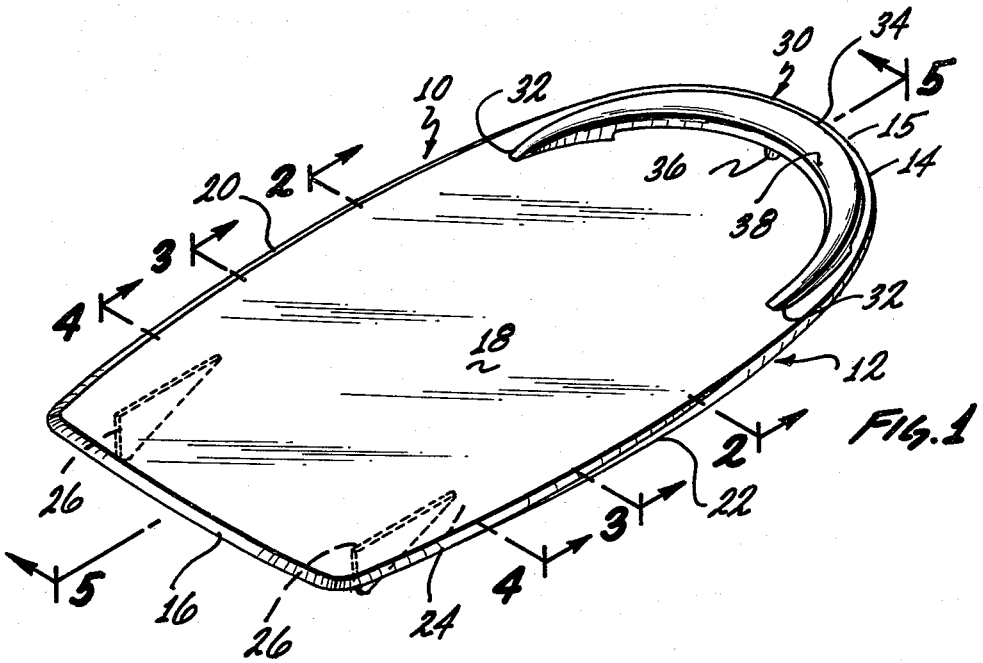
FIG. 1 is a perspective view of an improved body board according to one embodiment of this invention.

Turning to FIG. 1 of the drawings, a body board 10 comprises a substantially planar body 12 having a rounded blunt forward end 14, a generally square rear end 16, a top side surface 18, an underside 24, and side edges 20 and 22 respectively. A pair of fins 26 may be added for stability.

The thickness of body boards varies, depending in part on the material used for its construction. Certain beach areas require by local ordinance that body boards such as the one illustrated be made of a lightweight, relatively soft material such as a synthetic foam in order to minimize the risk of injury to swimmers and bystanders. Boards made of soft lightweight material are relative thick, and may be up to three to four inches in thickness. Other boards may be constructed of conventional materials, including fiber glass or plywood among other possibilities, and can therefore be made thinner due to the ridigity and greater strength of such materials. Thus, boards of one to one and one-half inches in thickness become practical. It has been found that the thinner boards made of more rigid material move more quickly through the water and are more agile and responsive to the rider's steering and can generally outmaneuver the thicker soft boards.

The improved body board of the present invention, as illustrated in FIG. 1, includes a substantially rigid arcuate member 30 secured in fixed spaced relationship to the upper side 18 of the body board. The bow-shaped arcuate member 30 has two ends 32 secured to the body board and a convexly-curved intermediate portion 34 oriented towards the forward end 14 of the body board. In the illustrated preferred embodiment of the invention, the arcuate control member 30 is also supported at the intermediate portion 34 by means of a post member 36 secured to the upper side 18 of the body board.

Figure 2:
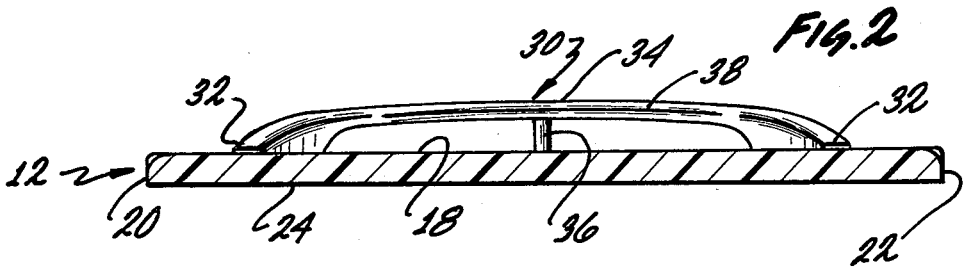
FIG. 2 is a cross section of the board taken along line 2—2 of FIG. 1.
Figure 3:
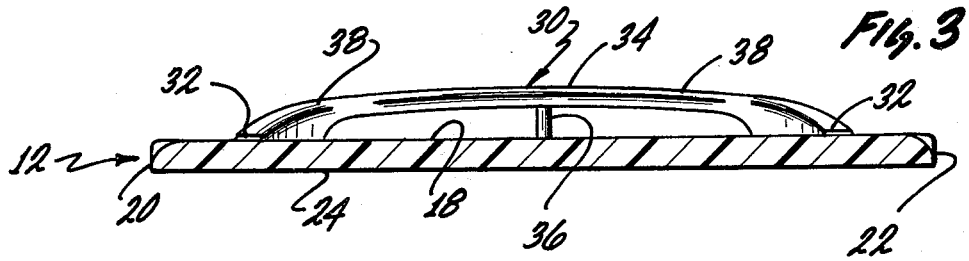
FIG. 3 is a second cross section of the board taken along line 3—3 in FIG. 1.

As best seen in FIG. 2, the control member 30 is of flattened cross section and includes a planar, generally horizontal upper surface 38 which is wider at the intermediate portion 34 than at either end. The control member 30 is attached to the board 12 such that when viewed in side elevation as in FIG. 3 the control member rises or slants upwardly from the upper surface 18 of the board in a forward direction. Thus, the intermediate portion 34 is spaced from the upper surface 18 by a greater distance than the ends 32.

The rearwardly-extending end portions 32 preferably terminate substantially flush with the upper side 18 of the board 12. This is desirable in that a rider can be thrown over the board so as to slide forwardly over the control member 30 without risking severe injury, since there is a smooth transition from the upper surface 18 onto the upper surface 38 of the control handle. The rider's torso thus slides freely without encountering substantial obstruction which might tear the skin or otherwise injure the rider.

The arcuate shape of the control handle 30 allows optimal leverage to be obtained over the board for improved control under a variety of load and surf conditions. Thus, a rider's hands may be spaced apart comfortably along the bow-shaped handle 30 which spans the greater part of the width of the board between the two ends 32. Thus, in a cruising attitude the rider may simply rest his hands in spaced relationship on the handle in a natural, comfortable position. For maneuvering, however, the grip of either or both hands may be shifted to any position along the handle that the rider instinctively feels will provide optimal leverage for a desired steering maneuver under given load and surf conditions.

The vertical spacing of the control member 30 from the upper side 18 of the board should be, at a minimum, such as to allow the rider to comfortably grip the handle 30 with the palm of the hand resting on the upper surface 38 and the fingers curling forwardly and underneath the control handle to allow a sure and positive grip thereon. This spacing should also allow the rider to shift the grip of either hand continuously along the handle 30 across a major portion of the width of the board. Where a supporting post member 36 is provided for the forward portion of the handle, uninterrupted sliding movement of the hands across the length of the handle may still be obtained by limiting the post to a rear portion of the width of the handle at the point of support so as to leave a forward overhang 40 such that a rider's fingers may still slide underneath the handle at the overhang without fully releasing the grip.

The arcuate shape of the control grip 30 allows comfortable sliding movement of the hands over the entire length of the grip and also comfortably permits a hand-over-hand grip to be effected at any point along the handle, even near the ends 32 if it is desired to apply maximum leverage near the end portions, as, for example, to obtain a sharp turning maneuver in one direction or another. A hand-over-hand grip at lateral extremes would be more difficult with a straight grip, for example, and under actual surfing conditions the ease of control over the board provides a significant competitive advantage. Clearly, such wide range of control and optimum leverage is simply not obtainable with small, centrally positioned handles used in the past.

Figure 4:
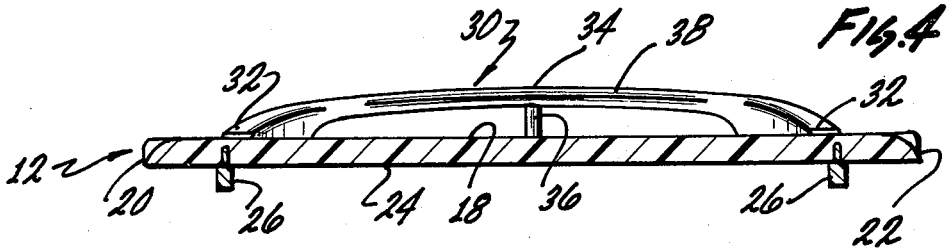
FIG. 4 is a third cross section taken along line 4—4 of FIG. 1.
Figure 8:
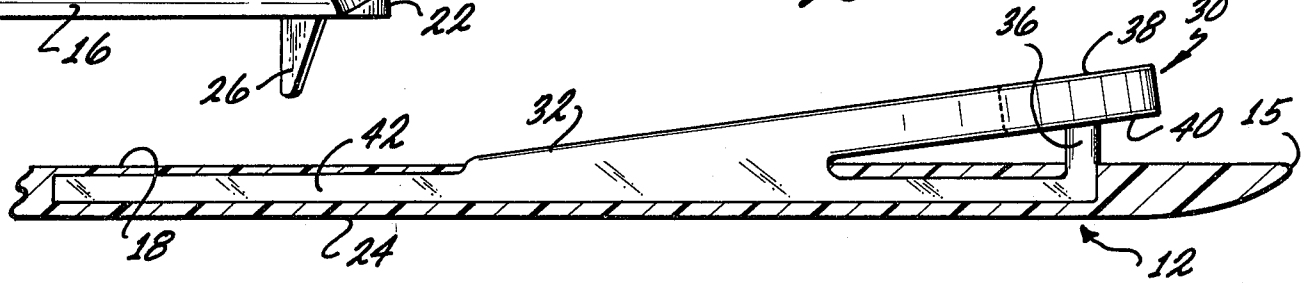
FIG. 8 is a partial longitudinal cross section of an alternate embodiment of the board wherein the bow handle is anchored to the board by runners embedded within the board.

An alternate embodiment of the invention is shown in FIG. 8 wherein the control grip 30 is secured to the board 12 by means of runner elements 42 extending rearwardly from the end portions 32. The runners 42 are embedded within the material of the board 12 and emerge from the board at the ends 32 to form the arcuate grip 30 which may otherwise be unchanged in its external shape from the embodiments of FIGS. 2–4. The runners 42 are desirable for use in soft body boards which are made of a single slab of a synthetic foam to securely anchor the same to the board. In the case of soft boards it is desirable to distribute steering forces through a substantial volume of the board material by means of such runners 42 which may extend to any desired length within the plane of the board and may also connect with the lower end of the spacer 36 at the forward end of the handle as shown in FIG. 8. Alternatively, the grip 30 may be secured to the board by means of fittings extending transversely through the thickness of the body board such as threaded fasteners, preferably of plastic material, or by snap-together type fasteners. It is possible, of course, to make the control handle 30 unitary with the body board 12 as by injection-molding the entire assembly in an appropriate mold or by other manufacturing methods which will be apparent to those skilled in the art. It is also contemplated within the scope of this invention that the control grip 30 be made removably attachable to an existing board 12 by any suitable means.

The bow shaped handle of this invention may be fabricated from any suitable materials or a composite of different materials having sufficient rigidity to transmit readily to the board manual forces applied to the control member. Thus, the control handle 30 may be made of plywood, or of a rigid plastic foam. If desired, a rigid strong core material may be covered with a relatively soft resilient outer layer for increased comfort without sacrificing leverage or control, as well as minimizing the chance of injury to others in the event of a collision.

Figure 5:
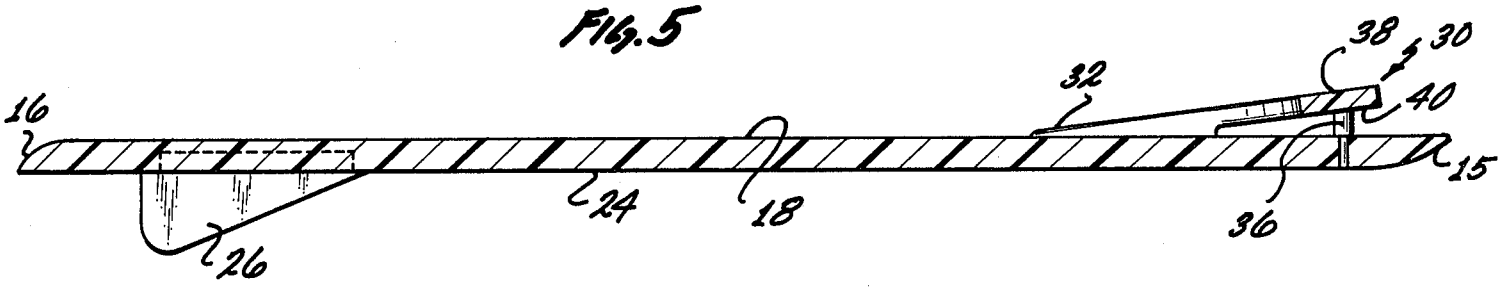
FIG. 5 is a longitudinal cross section of the board taken along line 5—5 of FIG. 1.
Figure 6:
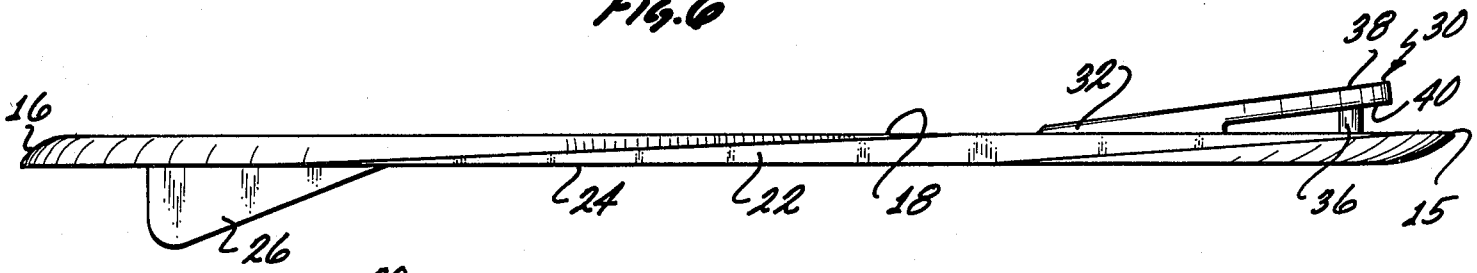
FIG. 6 is a side view of the board of FIG. 1.
Figure 7:
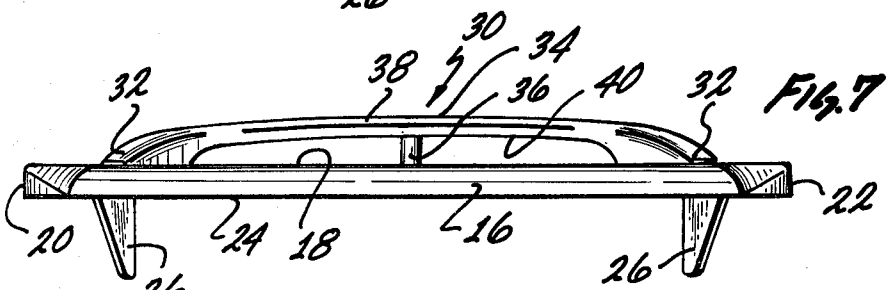
FIG. 7 is a rear view of the board of FIG. 1.

The body board itself is preferably substantially planar and approximately one to one and one-half inches in thickness, and may also be made of commonly available plywood treated with an impermeable covering such as marine varnish or equivalent substance. The edges of the board are preferably contoured along the bow of the board as well as the rear portions of the side edges to improve the hydrodynamic characteristics of the board. The rounded bow or forward portion of the board is contoured such that the underside of the board curves continuously upwardly from the bottom to form an edge 15 with the planar upper surface 18 as shown in the side views of FIGS. 5, 6 and 8. Water is thus directed in a smooth flow underneath the board and a force component is developed to lift slightly the forward end of the board for reduced drag. The rear portions of the side edges 20 and 22 are also tapered, but in a reverse sense from the bow, that is, the upper surface tapers downwardly at the edges to meet the lower surface 24. As shown in the spaced cross sections of FIGS. 2, 3 and 4 this taper of the side edges is present at the middle of the board as a small rounding of the upper portion of the edge and the rounded portion increases along the side edges towards the rear of the board as shown in the progression from FIG. 2 to FIG. 3 and then reaches the maximum taper as in FIG. 4 where no vertical portion of the side edge remains planar, but the upper surface 18 smoothly curves downwardly to meet the underside 24 in a continuous curve. The progression of this taper along the side edge of the board may be seen in the side view of FIG. 6 where the taper begins just rearwardly of the control member 30 and continues to the rear end 16 of the board. The board 12 may also be constructed of a composite including a thin rigid core and an outer soft resilient shock-absorbing layer and may be particularly padded around the edges for maximum shock absorption.

While a preferred and an alternate embodiment of the invention has been shown and described above, it will be understood that yet other changes, modifications and substitutions may be made without departing from the spirit and scope of the invention. Applicant therefore intends to be bound only by the scope of the claims which follow.

What is claimed is:

1. In a relatively thin substantially planar body board of the type used for supporting a rider's torso in ocean surf and having an upper side, an underside, a forward end and a rear end, and a pair of lateral edges, the improvement comprising:

a substantially rigid arcuate control handle member having two handle ends and a convex intermediate portion;

said arcuate control member being secured in fixed spaced relationship to said upper side between said forward end and said rear end of the body board, said arcuate control member spanning the greater part of the width of said board between said lateral edges with said convex intermediate portion oriented towards the forward end of the body board and said handle ends extending rearwardly and terminating substantially flush with said upper side to form a substantially smooth transition from the upper surface of said board to the upper surface of the control handle such that a rider's hands can easily slide from said lateral edges onto and along said arcuate member at a continuously selectable point between said two handle ends to obtain variably optimal leverage for positive steering control over said body board under shifting load and surf conditions.

2. The body board of claim 1 further comprising spacer means for supporting said arcuate member at one or more points intermediate said handle ends.

3. The body board of claim 1 wherein said arcuate member is of flattened cross section and comprises a generally planar upper surface.

4. The body board of claim 1 or claim 3 wherein said arcuate member is wider at said intermediate convex portion than at said handle ends.

5. The body board of claim 1 wherein said handle ends comprise anchoring means embedded in said body board and extending within the plane of said board for securely retaining said arcuate member in a body board made of a relatively soft material.

6. The body board of claim 1 wherein said arcuate control member lies within a plane forming an angle of less than 45° with said upper surface of the body board.

* * * * *